US007564362B2

(12) United States Patent
Cole et al.

(10) Patent No.: US 7,564,362 B2
(45) Date of Patent: Jul. 21, 2009

(54) ALARM ACTUATED PET DOOR LOCK RELEASE MECHANISM

(75) Inventors: Brenda Cole, Reisterstown, MD (US); Julianne Sudman, Knoxville, TN (US); E. Douglas Grindstaff, Knoxville, TN (US)

(73) Assignee: Radio Systems Corporation, Knoxville, TN (US)

( * ) Notice: Subject to any disclaimer, the term of this patent is extended or adjusted under 35 U.S.C. 154(b) by 105 days.

(21) Appl. No.: 11/386,416

(22) Filed: Mar. 22, 2006

(65) Prior Publication Data

US 2007/0222621 A1 Sep. 27, 2007

(51) Int. Cl.
*G08B 23/00* (2006.01)

(52) U.S. Cl. ..... 340/573.1; 340/506; 340/573.3

(58) Field of Classification Search ..... 340/506, 340/3.1, 573.1, 573.3
See application file for complete search history.

(56) References Cited

U.S. PATENT DOCUMENTS

| | | | | |
|---|---|---|---|---|
| 507,322 | A | 10/1893 | Holmes | |
| 520,395 | A | 5/1894 | Edmonds | |
| 1,006,914 | A | 10/1911 | Cox | |
| 1,310,612 | A | 7/1919 | Eskelin | |
| 4,022,263 | A | 5/1977 | Beckett et al. | |
| 4,036,178 | A | 7/1977 | Lee et al. | |
| 4,497,133 | A | 2/1985 | Blenkinsop | |
| 4,837,560 | A | 6/1989 | Newberry | |
| 5,570,655 | A | 11/1996 | Targa | |
| 5,608,778 | A * | 3/1997 | Partridge, III | 455/411 |
| 5,642,092 | A * | 6/1997 | Dunne et al. | 340/326 |
| 5,651,331 | A | 7/1997 | Cleri, Jr. | |
| 5,652,563 | A | 7/1997 | Maus | |
| 5,992,096 | A | 11/1999 | De La Cerda et al. | |
| 6,297,739 | B1 | 10/2001 | Small | |
| 6,318,296 | B1 * | 11/2001 | Nguyen | 119/502 |
| 6,560,926 | B1 | 5/2003 | Gillett | |
| 6,710,714 | B2 | 3/2004 | Conway | |
| 6,771,181 | B1 * | 8/2004 | Hughen, Jr. | 340/693.5 |
| 2004/0100386 | A1 * | 5/2004 | Tendler | 340/573.3 |

* cited by examiner

*Primary Examiner*—Daryl Pope
(74) *Attorney, Agent, or Firm*—Pitts & Brittian, P.C.

(57) ABSTRACT

A pet door having a locking mechanism for normally limiting ingress and egress, the pet door being adapted communicate with a conventional environmental detector to unlock the locking mechanism when a hazard environmental condition is detected. The pet door is adapted to work in cooperation with either a conventional smoke detector or an improved smoke detector. In one embodiment, a radio frequency (RF) transmitter is used in cooperation with a conventional smoke detector to communicate with a pet door of the present invention. In either embodiment, when the smoke detector detects an event such as the presence of smoke and/or fire such that an audible alarm is sounded, the pet door locking mechanism is unlocked. The pet door is also useful in cooperation with other detectors such as a carbon monoxide detector or a security alarm.

9 Claims, 6 Drawing Sheets

ALARM ACTUATED PET DOOR LOCK RELEASE MECHANISM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The present invention pertains to the field of pet doors. More particularly, this invention is related to a pet door having a lock mechanism provided for selected ingress and egress therethrough, the pet door being provided with an alarm-actuated mechanism for automatically disengaging the lock mechanism to allow the safe egress of any animal in the associated structure.

2. Description of the Related Art

In the field of pet care, it is well known that pets face the same dangers as humans when in emergency situations such as house fires. Often, when pets are lost in fires, the loss to the owners is like that of the loss of a family member. It is further well known that many pet doors have locking mechanisms for selectively controlling the ingress and egress of animals into and out of the associated structure. Representative pet doors include electronic devices that control the allowable times and direction of passage through the pet door, as well as the allowed animals which may pass therethrough.

Typical of the art are those devices disclosed in the following U.S. Patents:

| U.S. Pat. No. | Inventor(s) | Issue Date |
|---|---|---|
| 4,022,263 | R. W. Beckett et al. | May 10, 1977 |
| 4,036,178 | B. T. Lee et al. | Jul. 19, 1977 |
| 4,497,133 | P. T. Blenkinsop | Feb. 5, 1985 |
| 5,570,655 | A. Targa | Nov. 5, 1996 |
| 5,992,096 | P. De La Cerda et al. | Nov. 30, 1999 |
| 6,297,739 | D. K. Small | Oct. 2, 2001 |
| 6,560,926 | M. E. Gillett | May 13, 2003 |

Of these patents, Beckett et al., disclose, in their '263 patent, a magnetically actuated cat door wherein the a cat can wears a magnet which allows free ingress and egress through a pet door while other cats are effectively barred from entering.

Lee et al. ('178), disclose an electronic lock and key system for allowing access into and out of a structure by a selected animal and preventing access by all other animals. A passive key provides selective access without having a self contained power source. In this passive transponder arrangement, a passive electronic key processes induced or radiated electronic signals to generate a transponder signal for controlling access.

In his '133 patent, Blenkinsop discloses a control circuit for unlatching a pet door, the control circuit including a transmitter coil, a pulse driver for pulse energizing the coil, and a discriminator for detecting a.c. components in the coil current caused by currents induced in an outside tuned circuit brought adjacent the coil, e.g. around the neck of a pet seeking entry, and for comparing the frequency of the a.c. components with a standard. A latch drive circuit responds to the discriminator for operating the door latch if the frequency comparison is satisfactory.

Targa, in his '655 patent, discloses a device for deterring animal access to a location. The '655 device includes a generator for generating a field and a sensor for sensing the presence of the field near the location. One of the generator and the sensor is removably secured on an animal. A deterrent output signal unit is responsive to the sensor for generating an output signal in the presence of the field, the output signal being of sufficient magnitude to deter the animal from the location.

The '096 patent issued to De La Cerda et al., discloses a controllable animal access system connectable to the door of a building which has an opening covered by a pivotally moveable animal door. The animal access system of the '096 patent has a motion detector associated with a reader which detects an encoded pet tag worn by a selected animal and actuates locking and unlocking mechanisms in response to reading an accepted code.

Small ('739) discloses a system and method for providing access to a secured enclosure, such as a house or a fenced yard, to only a set of one or more selected animals. Each selected animal carries an identification device with an identifying code. An identification sensor scans for a selected identification device upon the detection of an animal's existence near the animal door. For detecting an animal at the outside of the animal door, a weight sensor is used, and for detecting an animal at the inside of the animal door, a motion sensor is used. The weight sensor is also configured to discriminate between the weight of each of the selected animals from unauthorized animals.

Gillett, in the '926 patent, teaches a pet door unit having a housing, an opening mechanism, a pet door, a receiver and a portable transmitter. The opening mechanism includes a motor having a screw drive and a carriage connected to the top of the pet door. The carriage moves along the length of a screw shaft of the screw drive as the shaft rotates to open and close the door. A detector is mounted on each of the sidewalls of the housing to detect an object in the opening of the housing and prevent the door from closing when an object is detected in the opening. To open the door, a user presses a button on the portable transmitter which sends a signal to the receiver which activates the opening mechanism to move the door to the open position.

In order to assist the pet in leaving a dwelling, several devices have been provided for opening an enclosure such as a cage, a pen or a house in which the animal is housed, thus permitting the exit of the pet from the enclosure. Such devices typically respond to the detection of fire or smoke. However, should the devices fail to function to open an exit for the pet from the enclosure, no provision is made for a pet owner, a firefighter, or other rescue worker to locate the pet and remove the pet from danger.

Typical of the art are those devices disclosed in the following U.S. Patents:

| U.S. Pat. No. | Inventor(s) | Issue Date |
|---|---|---|
| 507,322 | A. R. Holmes | Oct. 24, 1893 |
| 520,395 | J. S. Edmonds | May 22, 1894 |
| 1,006,914 | C. S. Cox | Oct. 24, 1911 |
| 1,310,612 | E. Eskelin | Jul. 22, 1919 |
| 4,837,560 | C. L. Newberry | Jun. 6, 1989 |

-continued

| U.S. Pat. No. | Inventor(s) | Issue Date |
|---|---|---|
| 5,642,092 | G. Dunne et al. | Jun. 24, 1997 |
| 5,651,331 | C. J. Cleri, Jr. | Jul. 29, 1997 |
| 5,652,563 | A. B. Maus | Jul. 29, 1997 |
| 6,318,296 | T. T. Nguyen | Nov. 20, 2001 |
| 6,710,714 | M. Conway | Mar. 23, 2004 |

Holmes, in his '322 patent, teaches an electric alarm system for use in horse stables. The alarm system is adapted to alert a remote location of a fire in the stable, and will automatically releases the horses housed in the stable in the event a fire is detected. Edmonds, in his '395 patent, as well as Cox in his '914 patent, disclose similar alarm and release systems using mechanical levers and cables. Eskelin ('612) provides yet another system for releasing livestock, the system using a flexible connector that is burnable or capable of being melted. When a fire burns the connector, weights at one end of the connector fall and engage the end of a sliding rod. The rod is connected to the locking devices on the stall gates such that when the rod is so engaged, the rod is slid and the locking devices are unlocked, thereby releasing the livestock.

Newberry, in his '560 patent, discloses an apparatus for automatically unlocking the guard bars on a window in response to the output signal of a fire detection device. A smoke alarm includes a pair of relay-controlled contacts used in conjunction with a solenoid arrangement to unlock the window bars. Power to the smoke detector and the solenoid circuit is supplied by a rechargeable battery.

The '092 patent issued to Dunne et al., teaches an automatic evacuation assistance system for assisting animals or people in existing a structure. The '092 device includes an event detector, such as a smoke detector for providing an event detection signal. The event detection signal is received by an exit control device which is coupled to an exit opening, for allowing the exit opening to open, providing an exit path to the outside of a structure. A transmitter transmits an alert in the form of a sound, smell, or visual signal to attract the person or animals to the exit path and exit opening.

Cleri, Jr., in his '331 patent, teaches an escape device for pets including a passageway opening from the inside to the outside of the enclosure. The passageway is normally closed by a primary door. An apparatus is provided for opening the door at the onset of a smoke emitting emergency such as a fire such that the door is open for safe egress for the pet or pets. Cleri further provides for a pre-recorded message preferably in the owner's voice directing and/or commanding the pet or pets to the open passageway.

The '563 patent issued to Maus discloses a safety system for a stable. The '563 device includes "smart detectors" installed in the stable for detecting at least one abnormal condition in the stable, a siren and/or flashing strobe installed in each stall for spooking horses out of their stalls, an electromagnetic lock provided on each said door, a power source supplying power to each said electro-magnetic lock keeping each door closed in the absence of the abnormal condition, and a controlling means continually monitoring the "smart detectors." Once the abnormal condition has been detected, the controlling unit immediately turns down the power supplied to each electromagnetic lock and, with a certain delay, actuates the siren and/or flashing strobe.

Nguyen, in the '296 patent, teaches an animal holding facility with an automatic evacuation system. An automatic fire, smoke and/or carbon dioxide detection system utilizing a plurality of smoke, fire and/or carbon monoxide sensors is disclosed by Nguyen. An audible alarm activates upon triggering of the sensors. A common fire door opens automatically and a hydraulic animal ejection means gently sweeps or guides the animal out of the kennel through the fire exits.

Conway discloses a system and method for freeing a pet from a portable holding cage in his '714 patent. The portable holding cage is provided with a door that can be locked in a closed position by an electromechanical lock. The operation of the lock is controlled by a systems controller which monitors alarm signals transmitted to it from a remote smoke detector. The transmitted alarm signals can be audible alarm signals, radio alarm signals or optical alarm signals. Once the alarm signal is received and identified by the systems controller, the systems controller activates the lock and opens the door to the holding cage.

BRIEF SUMMARY OF THE INVENTION

The present invention is a pet door having a locking mechanism normally in a locked condition, whereby the locking mechanism is automatically unlocked in the event an environmental hazard such as smoke, fire or carbon monoxide is detected. The pet door is adapted to work in cooperation with either a conventional or an improved smoke detector. In one embodiment, a radio frequency (RF) transmitter is used in cooperation with a conventional smoke detector to communicate with a pet door of the present invention. In either embodiment, when the smoke detector detects an event such as the presence of smoke and/or fire such that an audible alarm is sounded, the pet door locking mechanism is unlocked. The pet door is also useful in cooperation with other conventional or modified detectors for monitoring other environmental conditions, such as a carbon monoxide detector or a security alarm.

In a first embodiment, the pet door cooperates directly with a conventional smoke detector. The conventional smoke detector includes a sensor and a processing unit. The sensor is provided for detecting a change in environmental conditions, such as increased smoke content in the ambient air, increased air temperature, increased levels of carbon monoxide, and the like. Upon detection of a change in environmental conditions above a predetermined threshold, the processing unit triggers an audible alarm. The pet door is provided with circuitry for detecting the conventional smoke detector audible alarm and, in response, unlocking the locking mechanism.

The pet door includes a vibration sensor for detecting vibrations. The vibration sensor is a piezoelectric device. A microphone is provided to sample ambient sounds, simultaneously with the vibration sensor. The output of both the vibration sensor and the microphone are amplified by amplifiers and otherwise conditioned before being passed to a processing unit. The processing unit determines whether the detected sound is that of a conventional smoke detector and, if so, unlocks the locking mechanism.

In the event the conventional smoke alarm fails after sounding an initial alert, the pet door locking mechanism remains unlocked until the reset button is actuated in order to reset the processing unit to a standby mode.

In a second embodiment, an RF transmitter is used in cooperation with the conventional smoke detector. The conventional smoke detector is as described above. The RF transmitter includes the vibration sensor, microphone and amplifiers incorporated in the pet door of the previous embodiment. However, the RF transmitter, upon determining that the conventional smoke alarm has sounded an audible alarm, sends an RF signal to the pet door, which then unlocks the locking mechanism, as in the previous embodiment.

The pet door of this embodiment includes an RF receiver for receiving the RF signal transmitted by the RF transmitter. Upon receipt of the RF signal, the locking mechanism is unlocked, as described in the previous embodiment. In the preferred embodiment, the locking mechanism remains unlocked until a reset button is activated, thereby resetting the processing unit to a standby mode.

In a third embodiment, an improved smoke detector communicates directly with the pet door of the immediately previous embodiment. In this embodiment, the improved smoke detector is provided with an internal RF transmitter which generates an RF signal detectable by the pet door. When the alarm is sounded, the improved smoke detector simultaneously sends an RF signal to the pet door, which then unlocks the locking mechanism, as in the previous embodiment.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A pet door having a locking mechanism automatically unlocked in the event of a detected emergency condition is disclosed. Specifically, the pet door of the present invention is of the type including a locking mechanism for controlling ingress into and egress from a structure such as a dwelling, and is provided for being automatically unlocked when an alarm such as a smoke detector detects smoke, elevated heat, or other change in environment determined to be hazardous to the occupants. The pet door is adapted to work in cooperation with either a conventional or an improved smoke detector. In one embodiment, a radio frequency (RF) transmitter is used in cooperation with a conventional smoke detector to communicate with a pet door of the present invention. In either embodiment, when the smoke detector detects an event such as the presence of smoke and/or fire such that an audible alarm is sounded, the pet door locking mechanism is automatically unlocked to allow all animals to freely exit the structure. The pet door is also useful in cooperation with other conventional or modified detectors for monitoring other environmental conditions, such as a carbon monoxide detector or a security alarm.

The pet door of the present invention is illustrated generally at 10 in the figures. The pet door 10 includes a locking mechanism 60 provided for normally maintaining the pet door 10 in a locked position and for allowing specific pets to ingress and egress at will or within prescribed limits. The pet door 10 is adapted to communicate either directly or indirectly with a smoke detector 12, or other detector as set forth above. While the present invention may be used in cooperation with any conventional environmental detector as disclosed above, for ease of discussion, the present invention will be described as being used in cooperation with a smoke detector, without being limited to a smoke detector.

Figure 1:
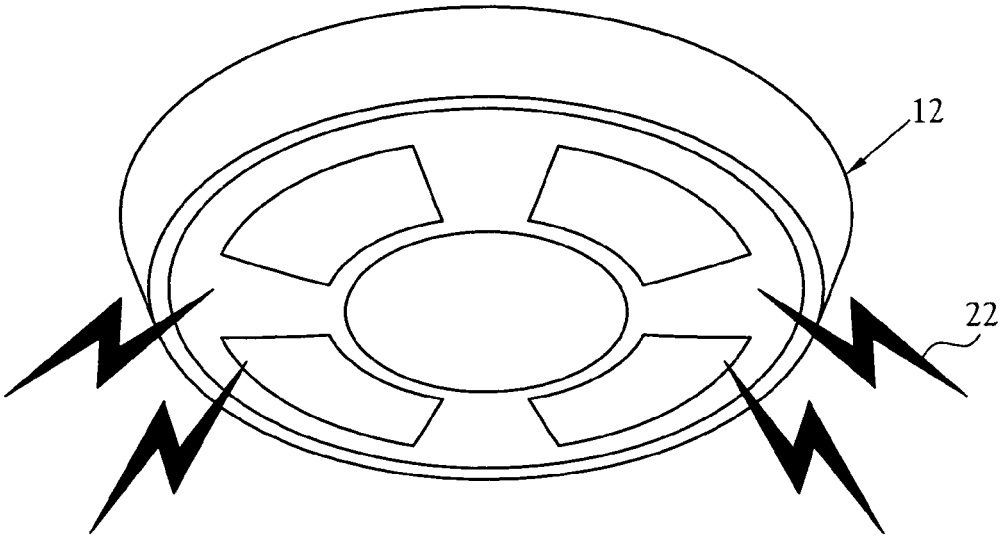
FIG. 1 is a perspective view of a pet door incorporating various features of the present invention and being used in cooperation with a conventional smoke detector.
Figure 1:
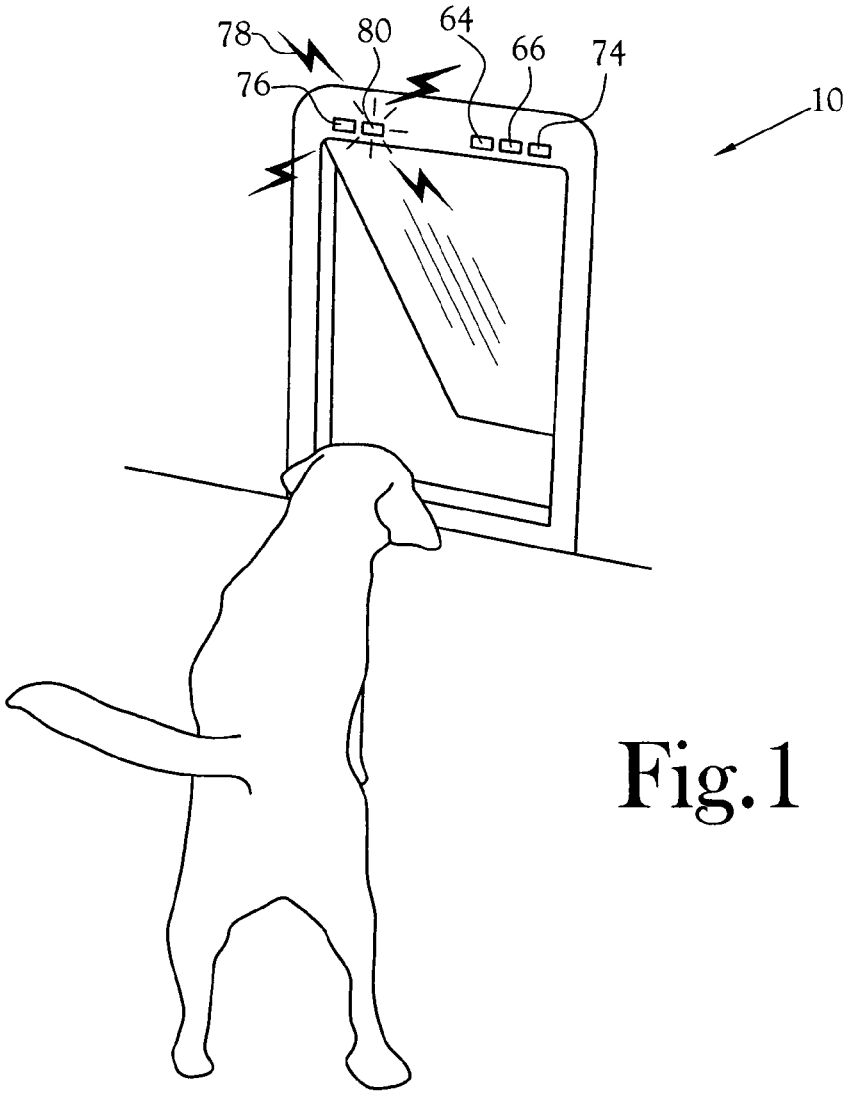

Illustrated in FIG. 1 is a pet door 10 of the present invention used in cooperation with a conventional smoke detector 12. In the conventional smoke detector 12, when a condition is detected such as smoke or fire, an audible alarm 20 is sounded. Typically, conventional smoke detectors 12 sound an alarm in the range of 85 decibels (dB) to 90 dB at a range of 10 feet. Depending on the application, the frequency of the alarm may be in the range of 250 Hz (such as in alarm systems for the hearing impaired) and up to 1500 Hz (such as in commercial or industrial alarms). When the alarm, represented by arrows 22, is sounded, the pet door 10 detects the alarm and in turn unlocks the locking mechanism 60 to allow any animal within the structure to exit freely, regardless of whether the animal is carrying a mechanism for otherwise unlocking the pet door 10. Further, simultaneously with unlocking the pet door 10, when the alarm 22 is sounded, the pet door 10 sounds a location alert 76, represented by arrows 78, and activates a visual alert 80 such as a light such that the pet door 10 is more readily located by the pet.

Figure 2:
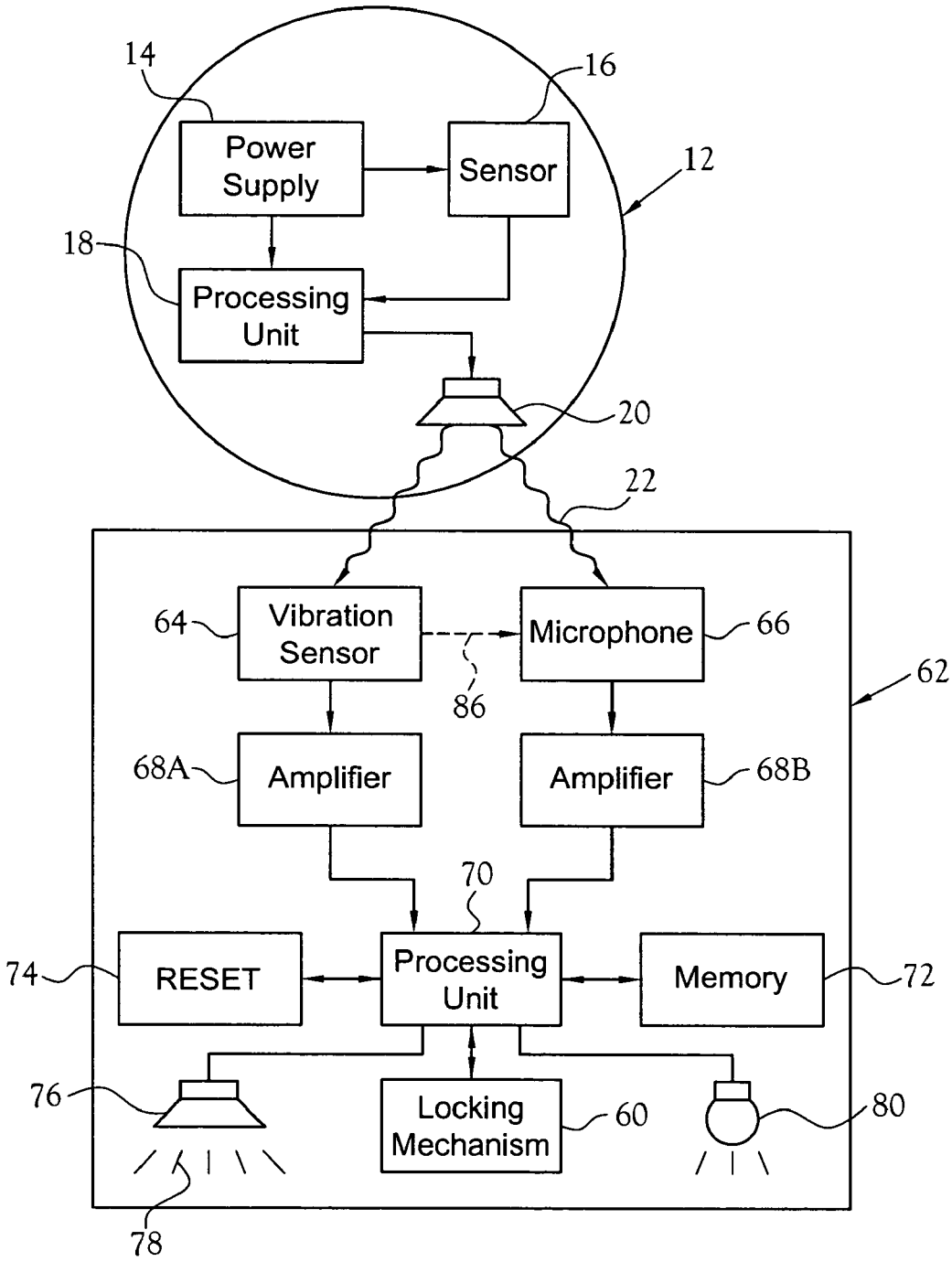
FIG. 2 is a schematic illustration of the pet door and conventional smoke detector illustrated in FIG. 1.

The embodiment illustrated in FIG. 1 is schematically illustrated in FIG. 2. The conventional smoke detector 12 includes a power supply 14, which can either be alternating current (AC) power supplied via a hardwire installation, or direct current (DC) power supplied via a battery. Power is supplied both to a sensor 16 and a processing unit 18. The sensor 16 is provided for detecting a change in environmental conditions, such as increased smoke content in the ambient air, increased air temperature, increased levels of carbon monoxide, and the like. Upon detection of a change in environmental conditions above a predetermined threshold, the processing unit 18 triggers an audible alarm via a speaker 20.

The pet door 10 houses electrical circuitry 62. The circuitry 62 includes a vibration sensor 64 for detecting vibrations. The vibration sensor 64 detects vibrations caused by sound waves, and is provided specifically for detecting the audible alarm 22 generated by the conventional smoke detector 12. In the illustrated embodiment, the vibration sensor 64 is a piezoelectric device. A microphone 66 is provided to sample ambient sounds, simultaneously with the vibration sensor 64. The output of both the vibration sensor 64 and the microphone 66 are amplified by amplifiers 68A and 68B, respectively, and otherwise conditioned before being passed to a processing unit 70. The processing unit 70 transforms the contemporaneous sample into vectors and compares those vectors against exemplary vectors representing an audible alarm 22 from a conventional smoke detector 12. If the contemporaneous vectors correspond to the exemplary vectors within predetermined tolerances, in conjunction with the signal detected by the vibration sensor 64, the processing unit 70 generates a positive discrimination result indicating that the sound is a smoke detector audible alarm 22. Upon receipt of a positive discrimination result, the locking mechanism 60 is unlocked, thereby allowing unencumbered ingress and egress through the pet door 10. Further, the location alert 76, represented by arrows 78, is sounded and the visual alert 80 is activated.

In the preferred embodiment, the vibration sensor 64 operates as a gating device for the microphone 66, as represented by connection 86. When vibrations are sensed by the vibration sensor 64, the microphone 86 is activated for sampling the detected sound. By activating the microphone 66 only when vibrations are sensed, two functions are accomplished. First, false triggers are dramatically reduced and the alert signaling is greatly improved. Second, power usage is reduced corresponding to the minimal activation of the microphone 66.

A memory device 72 is provided for storing an exemplary conventional smoke detector audible alarm 22 for comparison. As previously described, when the vibration sensor 64 detects a vibration indicating that the conventional smoke detector 12 is broadcasting an audible alarm, the microphone 66 is activated to sample the sound. The processing unit 70 discriminates between a conventional smoke detector audible alarm 22 and other ambient sounds. When the discrimination result indicates the sample sound is a conventional smoke detector audible alarm 22, the processing unit 70 compares the conventional smoke detector audible alarm 22 previously stored in the memory device 72 with the sample sound. Should the comparison of the stored conventional smoke detector audible alarm 22 and the contemporaneous sound sample indicate a match, the processing unit 70 generates the audible and visual alarms. Should the comparison of the stored conventional smoke detector audible alarm 22 and the contemporaneous sound sample indicate no match, the microphone 66 is powered OFF.

In the preferred embodiment, the locking mechanism 60 remains unlocked, the location alert 78 is sounded, and the visual alert 80 is activated until a reset button 74 is activated. To this extent, in the event the conventional smoke alarm 12 fails after sounding an initial alert 22, the pet door 10 remains unlocked such that an animal is still allowed to leave the structure, and the location alert 78 and visual alert 80 both remain active in order to make it easier for the pet to locate the pet door 10.

In order to train the pet to find the pet door 10, the locking mechanism 60 is in communication with the processing unit 70 to activate the audible alarm 78 and the visual alarm 80 in non-emergency situations as well. When the pet owner manually unlocks the locking mechanism 60, such as to allow or encourage the pet to egress through the pet door 10, the processing unit 70 causes the audible alarm 78 and the visual alarm 80 to briefly activate. In so doing, the pet is trained using Pavlovian techniques to respond to the alarms by locating and egressing through the pet door 10. Thus, while the pet becomes accustomed to locating and egressing through the pet door 10 in non-emergency situations, when an emergency arises and the audible alarm 78 and the visual alarm 80 are each activated, the pet has a conditioned response to locate and egress through the pet door 10.

Figure 3:
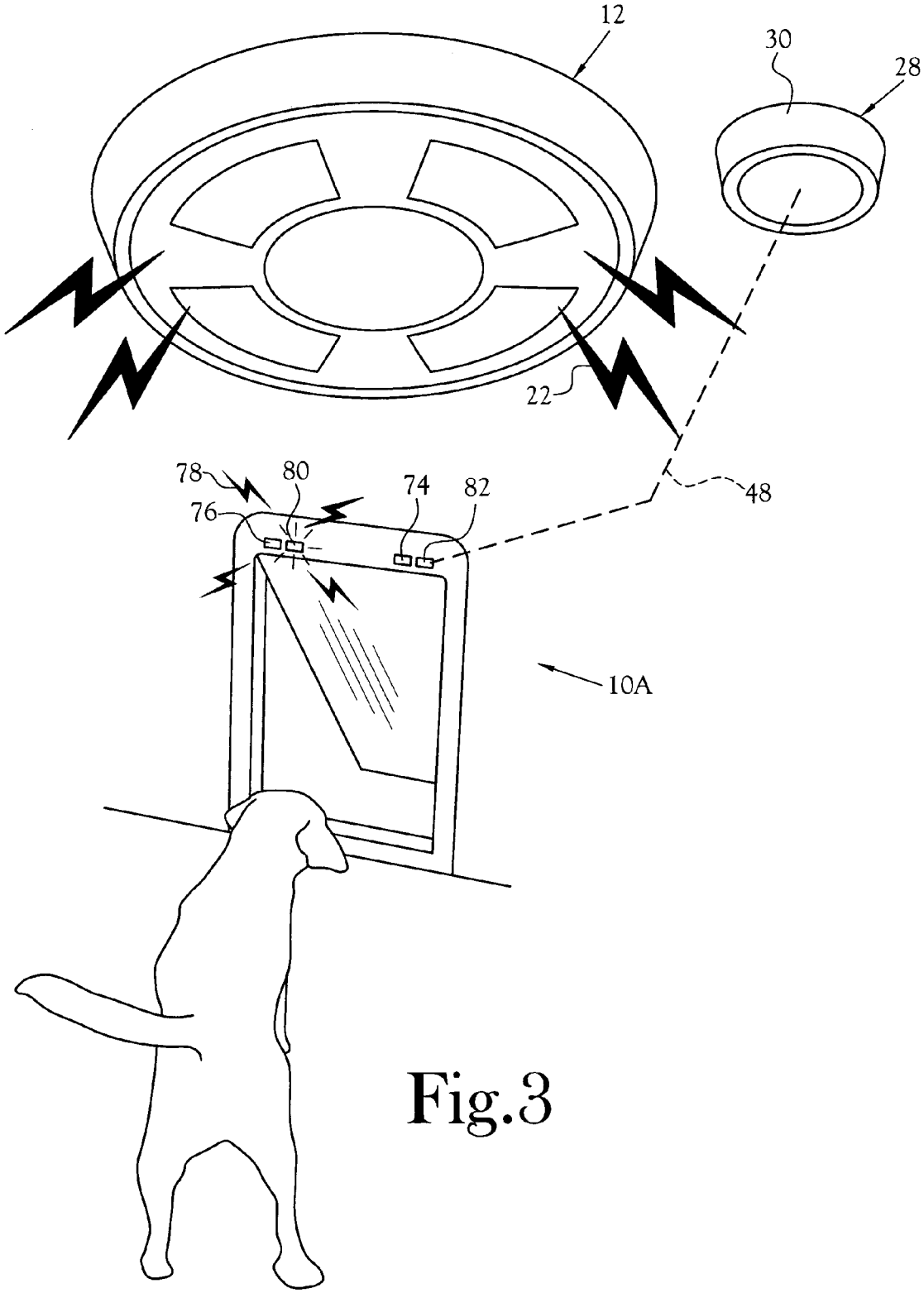
FIG. 3 is a perspective view of an alternate embodiment of a pet door in communication with an RF transmitter, both constructed in accordance with various features of the present invention and being used in cooperation with a conventional smoke detector.

FIG. 3 illustrates an alternate embodiment of a pet door 10A in communication with an RF transmitter 28 used in cooperation with a conventional smoke detector 12. The conventional smoke detector 12 is as illustrated in FIG. 1. When the alarm, represented by arrows 22, is sounded, the RF transmitter 28 detects the alarm 22 and in turn sends an RF signal 44 to the pet door 10A, which then unlocks the locking mechanism 60, as in the previous embodiment.

Figure 4:
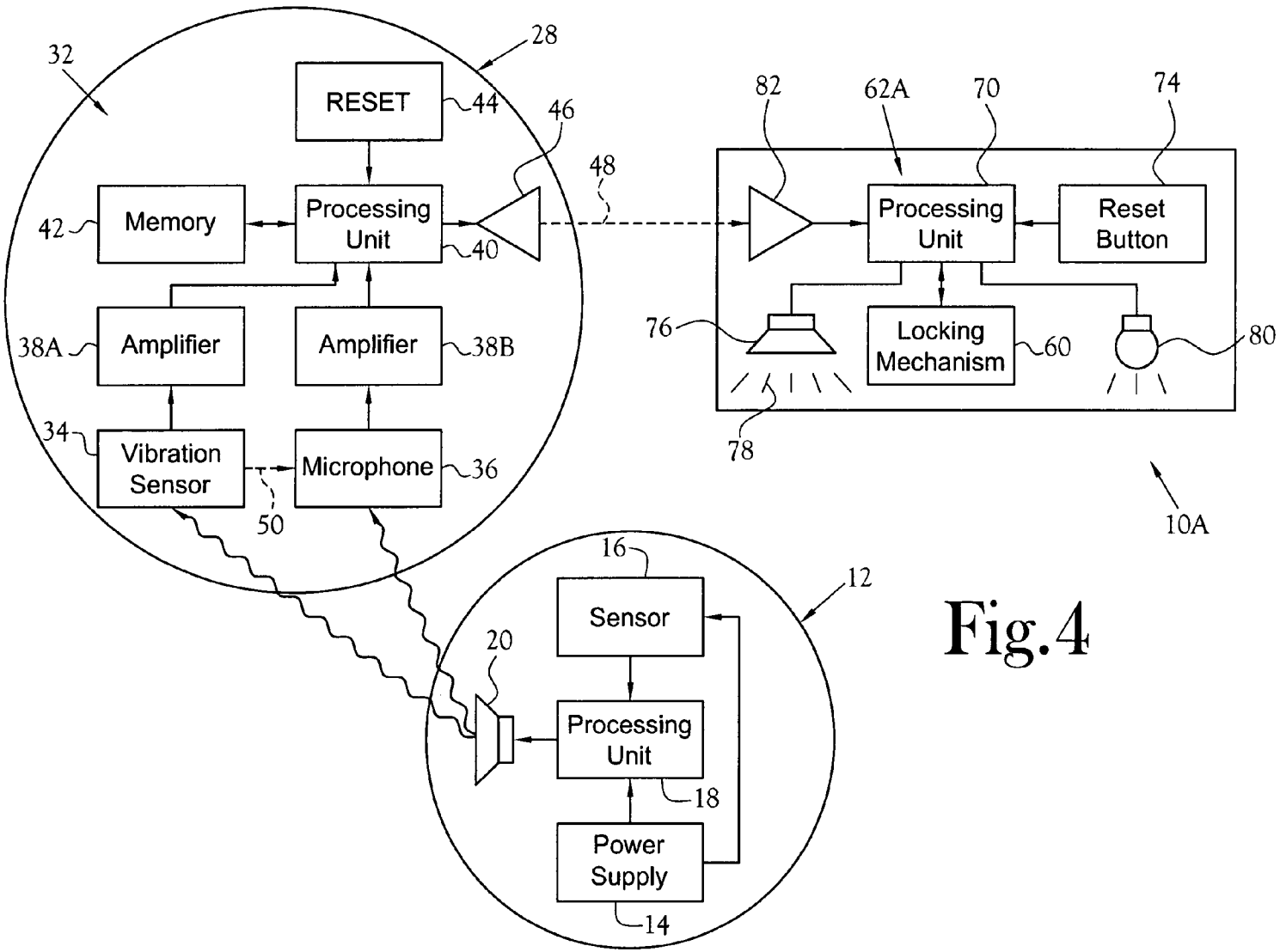
FIG. 4 is a schematic illustration of the pet door, RF transmitter and conventional smoke detector illustrated in FIG. 3.

The embodiment illustrated in FIG. 3 is schematically illustrated in FIG. 4. The conventional smoke detector 12 is as illustrated schematically in FIG. 2. The RF transmitter 28 is placed in close proximity to the conventional smoke detector 12 in order to best receive the conventional smoke detector audible alarm 22.

The circuitry 32 of the RF transmitter 28 is housed within a housing 30 such as that illustrated in FIG. 3. A vibration sensor 34 is provided for detecting vibrations. The vibration sensor 34 detects vibrations caused by sound waves, and is provided specifically for detecting the audible alarm 22 generated by the conventional smoke detector 12. As in the previous embodiment, the vibration sensor 34 is a piezoelectric device. A microphone 36 is provided to sample ambient sounds, simultaneously with the vibration sensor 34. The output of both the vibration sensor 34 and the microphone 36 are amplified by amplifiers 38A and 38B, respectively, and otherwise conditioned before being passed to a processing unit 40. The processing unit 40 transforms the contemporaneous sample into vectors and compares those vectors against exemplary vectors representing an audible alarm 22 from a conventional smoke detector 12. If the contemporaneous vectors correspond to the exemplary vectors within predetermined tolerances, in conjunction with the signal detected by the vibration sensor 34, the processing unit 40 generates a positive discrimination result indicating that the sound is a smoke detector audible alarm 22. Upon receipt of a positive discrimination result, an RF signal 48 is transmitted via the RF transmitter 46.

As in the previous embodiment, the vibration sensor 34 operates as a gating device for the microphone 36, as represented by connection 50. When vibrations are sensed by the vibration sensor 34, the microphone 36 is activated for sampling the detected sound. A memory device 42 is provided for storing an exemplary conventional smoke detector audible alarm 22 for comparison. When the vibration sensor 34 detects a vibration indicating that the conventional smoke detector 12 is broadcasting an audible alarm 22, the microphone 36 is activated to sample the sound. The processing unit 40 discriminates between a conventional smoke detector audible alarm 22 and other ambient sounds. When the discrimination result indicates the sample sound is a conventional smoke detector audible alarm 22, the processing unit 40 compares the conventional smoke detector audible alarm 22 previously stored in the memory device 42 with the sample sound. Should the comparison of the stored conventional smoke detector audible alarm 22 and the contemporaneous sound sample indicate a match, the processing unit 40 generates the RF signal 48. Should the comparison of the stored conventional smoke detector audible alarm 22 and the contemporaneous sound sample indicate no match, the microphone 36 is powered OFF.

The pet door 10A illustrated in FIG. 3 includes circuitry 62A. An RF receiver 82 is provided for receiving the RF signal 48 transmitted by the RF transmitter 46. Upon receipt of the RF signal 48, the locking mechanism 60 is unlocked as described in the previous embodiment. In the preferred embodiment, the locking mechanism 60 remains unlocked until a reset button 74 is activated, thereby resetting the processing unit 70 to a standby mode.

Figure 5:
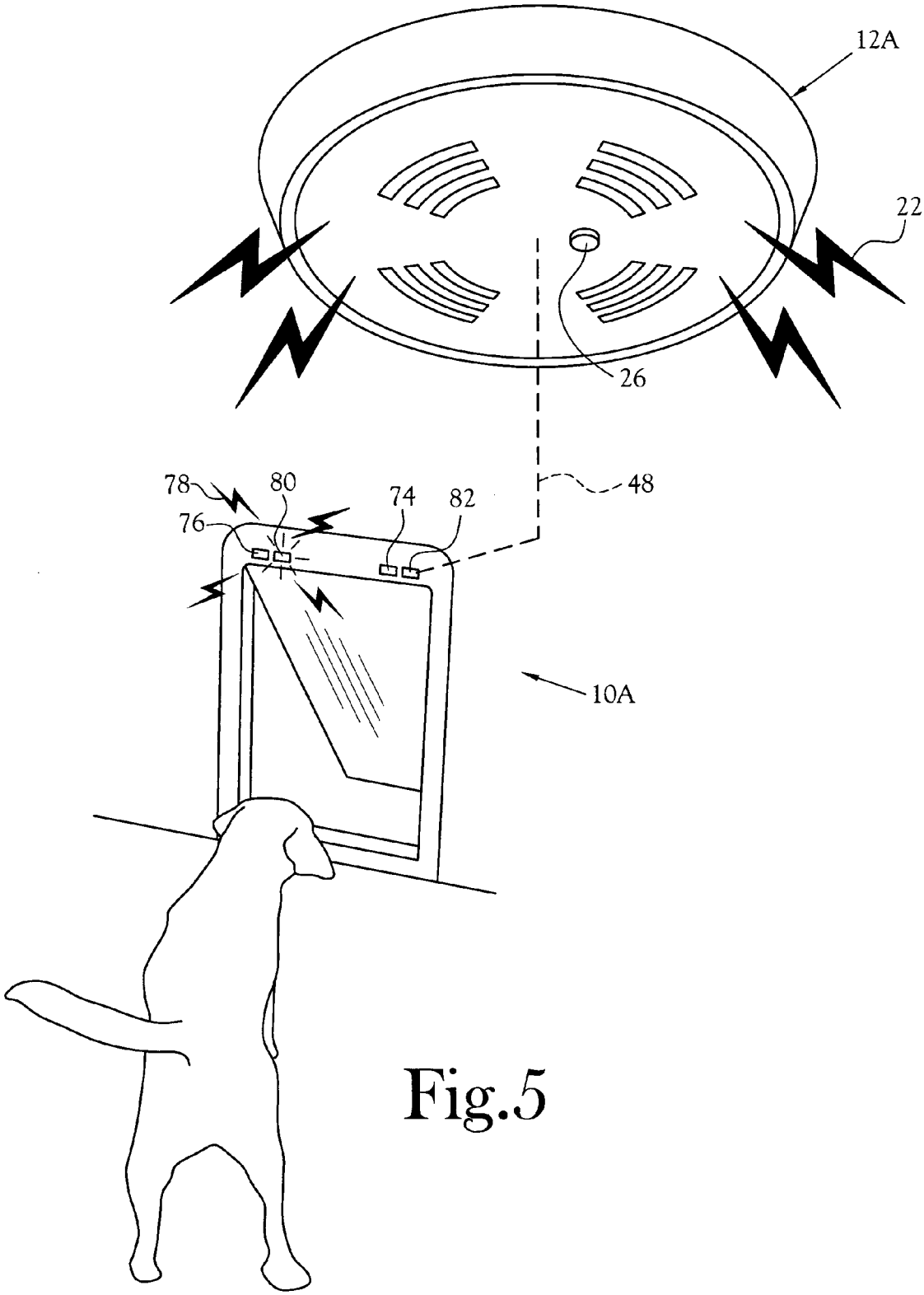
FIG. 5 is a perspective view of a further alternate embodiment of a pet door in communication with an improved smoke detector RF transmitter, both constructed in accordance with various features of the present invention.

FIG. 5 illustrates the alternate embodiment of the pet door 10A in communication with an improved smoke detector 12A. The improved smoke detector 12A, in addition to sounding an audible alarm 22, further generates an RF signal 48 which is detectable by the pet door 10A. When the alarm, represented by arrows 22, is sounded, the improved smoke detector 12A simultaneously sends the RF signal 48 to the pet door 10A, which then unlocks the locking mechanism 60, as in the previous embodiment.

Figure 6:
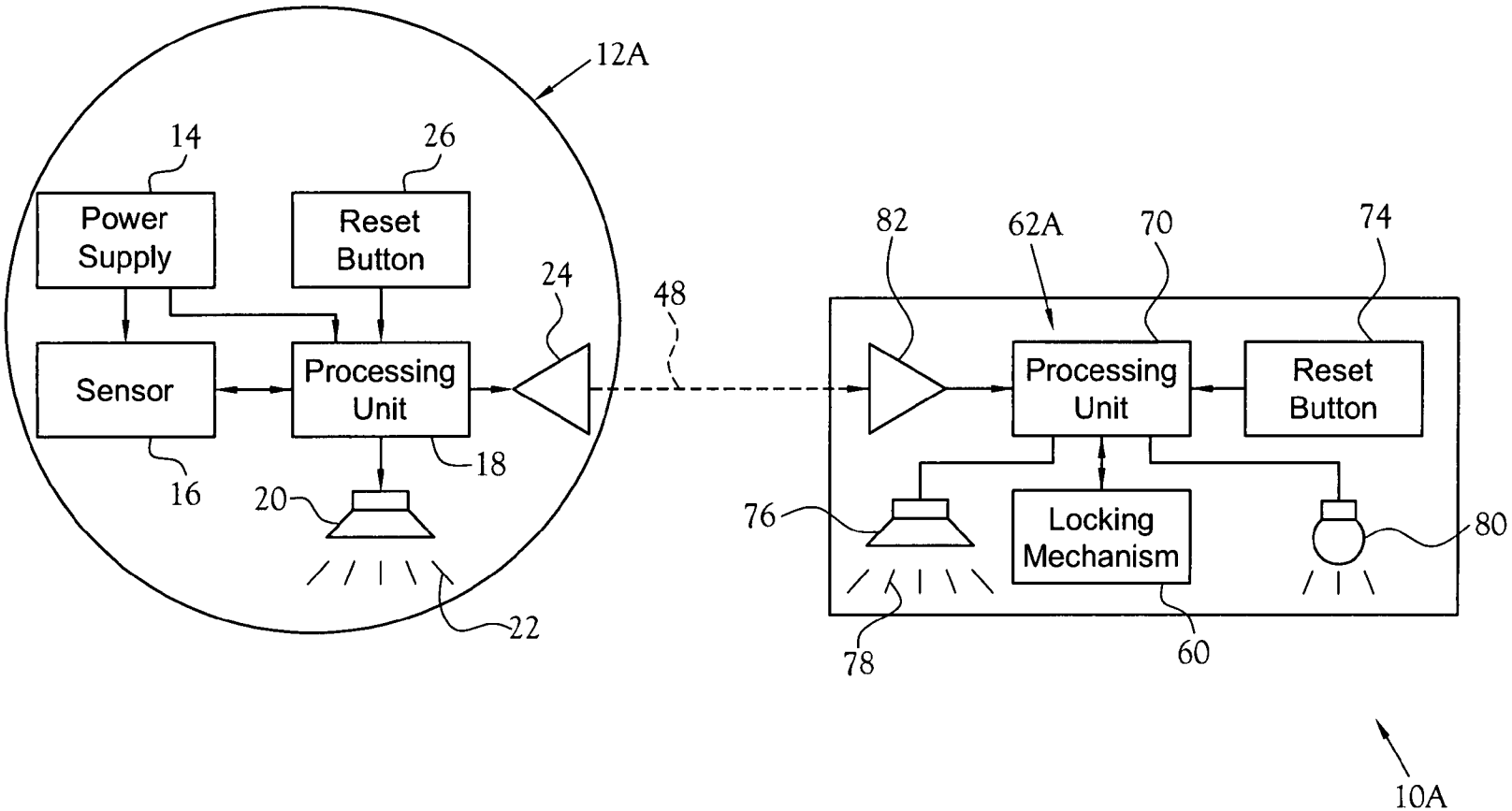
FIG. 6 is a schematic illustration of the pet door and improved smoke detector illustrated in FIG. 5.

The embodiment illustrated in FIG. 5 is schematically illustrated in FIG. 6. The improved smoke detector 12A includes the components included in the conventional smoke detector 12 as illustrated schematically in FIG. 2. The improved smoke detector 12A further includes an RF transmitter 24 provided for simultaneously broadcasting an RF signal 48 with the audible alarm 22. The pet door 10A used in association with the improved smoke detector 12A is the same as in the immediately previous embodiment schematically illustrated in FIG. 4.

In each of the various embodiments of the present invention, a smoke detector 12 is used to detect the presence of smoke, elevated temperature, or other environmental danger, and to broadcast an audible alarm 22. In two of the illustrated embodiments, an RF signal 48—either internal to the smoke detector 12A or external via an RF transmitter 28—is generated to be received by the pet door 10A. The pet door 10 receives either or both of the audible alarm 22 and the RF signal 48 and, in turn, unlocks the locking mechanism 60.

From the foregoing description, it will be recognized by those skilled in the art that a pet door for allowing pets to ingress and especially egress through the pet door in the event of a detected environmental hazard has been provided. The pet door of the present invention is of the locking type and is provided for unlocking a locking mechanism upon the event of a hazardous condition, as detected by a detector. The pet door is adapted to work in cooperation with either a conventional or an improved smoke detector. An RF transmitter may be used in cooperation with a conventional smoke detector, or incorporated into an improved smoke detector, to communicate with the pet door via RF signals. In either embodiment, when the smoke detector detects an event such as the presence of smoke and/or fire such that an audible alarm is sounded, the pet door is activated to unlock the locking mechanism. The pet door is also useful in cooperation with other conventional or modified detectors for monitoring other environmental conditions, such as a carbon monoxide detector or a security alarm.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, we claim:

1. A pet door used in cooperation with a conventional alarm device configured to produce an audible alarm when a hazardous environmental condition is detected, said pet door comprising:

a locking mechanism for selectively limiting ingress and egress;

circuitry in communication with said locking mechanism, said circuitry being adapted to unlock said locking mechanism; and an RF transmitter adapted to detect the audible alarm produced by the conventional alarm device, said RF transmitter being in wireless communication with said pet door circuitry, said RF transmitter including a processor for discriminating between the audible alarm of the conventional alarm device and other ambient noises, said RF transmitter signals said circuitry to unlock said locking mechanism when it detects the audible alarm.

2. The pet door of claim 1 wherein said RF transmitter circuitry further includes:

a vibration sensor for detecting vibrations;

a microphone for sampling ambient sounds simultaneously with said vibration sensor, said vibration sensor operating as a gating device for said microphone;

a memory unit for storing an exemplary conventional alarm device audible alarm, said processor comparing a sound sample with the exemplary conventional alarm device audible alarm; and an RF transmitter for transmitting an RF signal when said sound sample is confirmed as a conventional alarm device audible alarm; and wherein said pet door circuitry includes:

an RF receiver for receiving said RF signal; and a processor for unlocking said locking mechanism.

3. The pet door of claim 2 wherein said vibration sensor is a piezoelectric device.

4. A pet door used in cooperation with a conventional alarm device configured to produce an audible alarm when a hazardous environmental condition is detected, said pet door comprising:

an alarm device configured to produce an audible alarm when a hazardous environmental condition is detected;

a locking mechanism for selectively limiting ingress and egress;

circuitry in communication with said locking mechanism and adapted to unlock said locking mechanism; and an RF transmitter in wireless communication with said circuitry and adapted to detect the audible alarm produced by said alarm device, said RF transmitter including a processor for discriminating between said audible alarm of said alarm device and other ambient noises, said RF transmitter transmits a RF signal when said RF transmitter detects said audible alarm, said circuitry unlocks said locking mechanism when said circuitry receives the RF signal.

5. The pet door of claim 4 wherein said RF transmitter circuitry further includes:

a vibration sensor for detecting vibrations;

a microphone for sampling ambient sounds simultaneously with said vibration sensor, said vibration sensor operating as a gating device for said microphone;

a memory unit for storing an exemplary alarm device audible alarm, said processor comparing a sound sample with said exemplary alarm device audible alarm; and an RF transmitter for transmitting an RF signal when said sound sample is confirmed as said alarm device audible alarm; and wherein said pet door circuitry includes:

an RF receiver for receiving said RF signal; and a processor for unlocking said locking mechanism when said RF signal is received.

6. The pet door of claim 5 wherein said vibration sensor is a piezoelectric device.

7. A pet door used in cooperation with a conventional alarm device configured to produce an audible alarm when a hazardous environmental condition is detected, said pet door comprising:

a RF transmitter adapted to detect the audible alarm, said RF transmitter transmits a RF signal in response to detecting the audible alarm;

a locking mechanism being movable between a locked position and an unlocked position, said locking mechanism preventing ingress and egress by way of said pet door when at the locked position, said locking mechanism permitting egress by way of said pet door when at the unlocked position; and circuitry in electrical communication with said locking mechanism and adapted to receive the RF signal transmitted by said RF transmitter, said circuitry moving said locking mechanism to the unlocked position when said circuitry receives the RF signal.

8. The pet door of claim 7 wherein said RF transmitter includes a processor for discriminating between the audible alarm and ambient noises.

9. The pet door of claim 7 wherein said circuitry includes a receiver adapted to receive the RF signal.

* * * * *